US005690068A

United States Patent [19]

Astner et al.

[11] Patent Number: 5,690,068

[45] Date of Patent: Nov. 25, 1997

[54] ARRANGEMENT FOR MOUNTING AN AIR INTAKE MODULE ON AN INTERNAL COMBUSTION ENGINE

[75] Inventors: Josef Astner; Lucian Betke, both of Stuttgart; Angela Breymayer, Altbach; Manfred Wamser, Markgrönigen, all of Germany

[73] Assignee: Mercedes-Benz AG, Stuttgart, Germany

[21] Appl. No.: 760,069

[22] Filed: Dec. 4, 1996

[30] Foreign Application Priority Data

Dec. 21, 1995 [DE] Germany ..... 195 48 024.4

[51] Int. Cl.[6] ..... F02M 25/10; F01M 11/04

[52] U.S. Cl. ..... 123/184.21; 123/184.38

[58] Field of Search ..... 123/184.21, 184.28, 123/184.38, 184.42, 193.5

[56] References Cited

U.S. PATENT DOCUMENTS

| | | | |
|---|---|---|---|
| 4,898,125 | 2/1990 | Ampferer | 123/184.21 |
| 4,901,681 | 2/1990 | Pozniak et al. | 123/184.31 |
| 5,012,771 | 5/1991 | Oda et al. | 123/184.38 |
| 5,085,178 | 2/1992 | Hitomi et al. | 123/184.38 |
| 5,181,492 | 1/1993 | Izumi et al. | 123/184.38 |
| 5,477,819 | 12/1995 | Kopec | 123/184.42 |

FOREIGN PATENT DOCUMENTS

| | | |
|---|---|---|
| 448 431 | 9/1991 | European Pat. Off. . |
| 0 471 886 | 2/1992 | European Pat. Off. . |
| 27 02 261 | 8/1977 | Germany . |
| 40 17 074 | 11/1991 | Germany . |

*Primary Examiner*—David A. Okonsky
*Attorney, Agent, or Firm*—Klaus J. Bach

[57] ABSTRACT

In an arrangement for mounting an air intake module on an internal combustion engine including a cylinder head and a cylinder head cover wherein the air intake module comprises an air collector and air induction pipes mounted on the cylinder head and extending therefrom to the air collector, an oil filler pipe having one end mounted on the cylinder head cover extends to the air intake module and is firmly connected thereto so as to form a bracing structure for the air intake module.

5 Claims, 1 Drawing Sheet

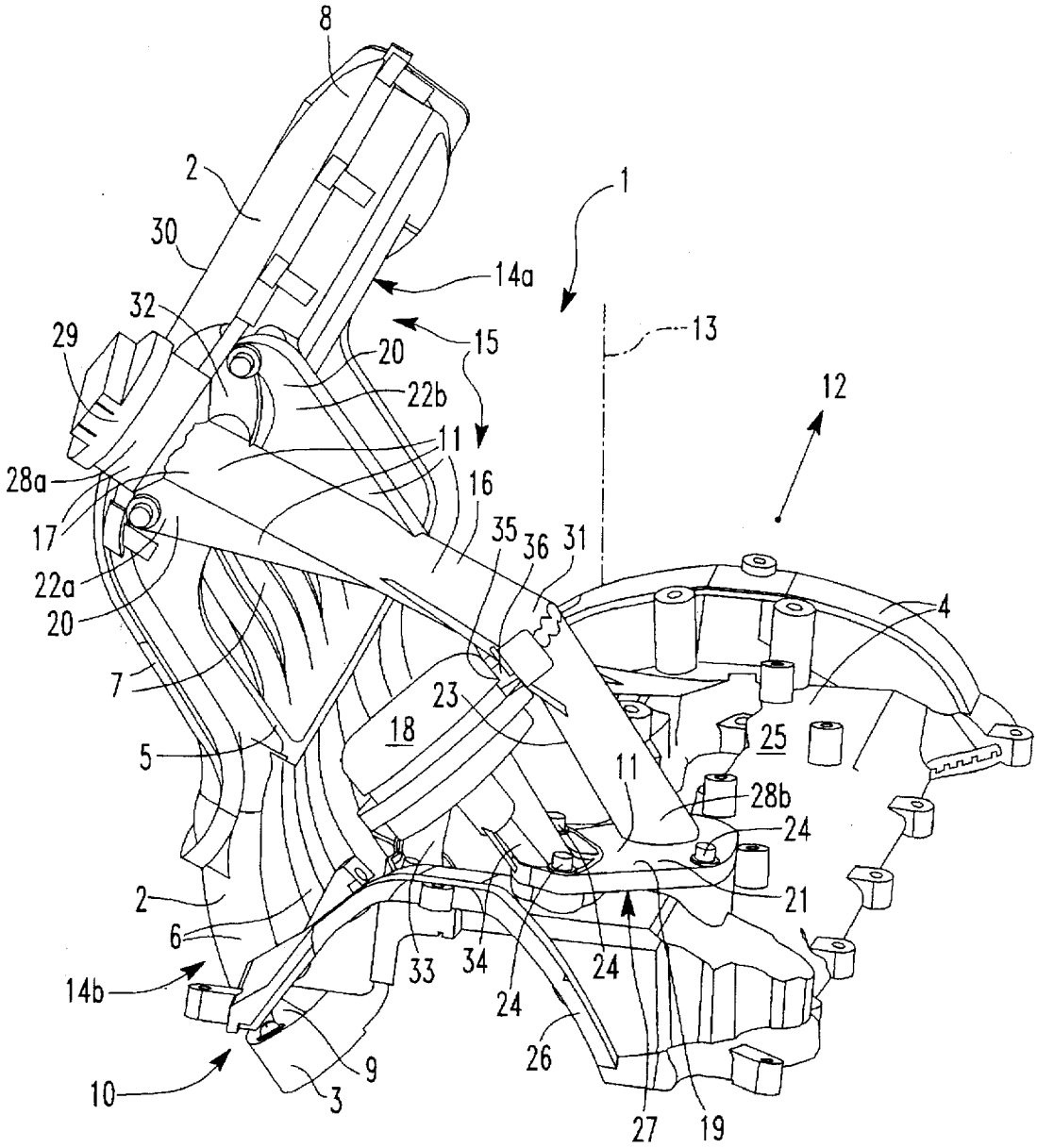
8
2
30
32
29
28a
17
22a
20
7
5
2
6
14b
10
3
9
33
34
24
24
26
27
19
21
24
28b
25
11
18
23
4
12
13
1
14a
15
20
22b
11
16
35
36
31

ARRANGEMENT FOR MOUNTING AN AIR INTAKE MODULE ON AN INTERNAL COMBUSTION ENGINE

BACKGROUND OF THE INVENTION

The invention relates to an arrangement for mounting an air intake module on an internal combustion engine which includes a cylinder head and a cylinder head cover, an oil filler pipe and an oil separator and the air intake module comprises an air collector and air intake ducts mounted to the cylinder head.

DE 40 17 074 A1 discloses an arrangement for mounting an air intake module onto an internal combustion engine wherein the air intake module includes an air filter and is mounted, by way of air intake ducts, on the side of the cylinder head of the internal combustion engine. On the side of the cylinder head opposite the air intake module there is a component unit including a pressure control valve, an oil filler neck and an oil lever gauge.

For general background information, reference is further made to DE 27 02 621 A1 and EP 0 471 886 B1.

All the arrangements referred to above however are subjected to high vibration stresses during operation of the engine since these air intake modules are generally supported on the engine only at their lower ends and project therefrom upwardly to an area above the engine. As a result, the air intake module is subjected to relatively high vibration movements resulting in high stresses.

It is the object of the present invention to provide a mounting arrangement for an air intake module of an internal combustion engine which results only in relatively small vibration amplitudes for the air intake module and which at the same time provides for a compact and variable arrangement of the components for mounting the air intake module.

SUMMARY OF THE INVENTION

In an arrangement for mounting an air intake module on an internal combustion engine including a cylinder head and a cylinder head cover wherein the air intake module comprises an air collector and air induction pipes mounted on the cylinder head and extending therefrom to the air collector, an oil filler pipe having one end mounted on the cylinder head cover extends to the air intake module and is firmly connected thereto so as to form a bracing structure for the air intake module.

An essential advantage of the invention resides in the fact that the support arrangement prevents large vibration amplitudes of the air intake module on the cylinder head. At the same time, the integration of the oil filler conduit into the support arrangement for the air intake module not only braces the support structure but combines an other function into the module.

Preferably, the support arrangement forms a unitary multi-function component which includes an oil filler pipe, an oil filler neck, a first mounting means assigned to the cylinder head cover and a second mounting means assigned to the air intake module. With this arrangement a number of separate mounting component can be omitted so that savings in weight but also a reduction in manufacturing costs can be realized.

It is further advantageous if also the oil separator is included integrally into the multi-function support arrangement so that the manufacture and the mounting of a separate oil separator becomes superfluous.

Preferably, the support structure including the oil separator are formed by injection molding since relatively complicated parts can be made with this procedure relatively easily. The support structure may consist for example of a heat resistant plastic material which tolerates the temperature to which it is exposed at the intake side of an internal combustion engine.

Further features and advantages of the invention will be apparent from the following description thereof on the basis of the attached drawing.

BRIEF DESCRIPTION OF THE DRAWINGS

The sole FIGURE is a perspective view of an air intake module—oil filler pipe mounting arrangement.

DESCRIPTION OF A PREFERRED EMBODIMENT

The figure shows the mounting arrangement 1 for supporting an air intake module 2 on an internal combustion engine which includes a cylinder head 3 of which only a small section is indicated in the figure, a cylinder head cover 4 and a crankcase which however, is not shown in the drawing.

The air intake module 2 is an integral component comprising several induction pipes 6 which are arranged in side-by-side relation and interconnected by a web 5 and at whose upper ends 7 an air collector 8 is mounted. At the lower ends 9 of the induction pipes 6, the air intake module 6 is flanged to an inlet side 10 of the cylinder head 3 and is mounted to the cylinder head cover 4 by way of a bracing structure 11.

In longitudinal direction 12 of the engine, the air intake module 2 extends essentially over the full length of the cylinder head 3 and parallel to the engine vertical axis 13. At its upper end 14*a*, the air intake module 2 is slightly curved toward the cylinder head cover 4. In the example shown, the air intake module 2 is shaped so as to define with the induction pipes 6 and the air collector 8, a space 15 for the installation of an air filter and an exhaust gas turbocharger including intake air compressor.

The engine is installed in a vehicle in an inclined position such that the center of gravity of the air intake module is disposed, when seen in the direction of engine vertical axis 13, to the side about above the cylinder head cover 4. With this installation position, there is a moment effective on the air intake module 2 which however is counteracted by the bracing structure 11.

The bracing structure 11 for bracing the air intake module 2 on the cylinder head cover 4 is a unitary multifunction part comprising an oil filler pipe 16, an oil filler neck 17 an oil separator 18, a first mounting means 19 for attachment to the cylinder head cover 4 and a second mounting means 20 for attachment to the air intake module 2. The first mounting means 19 includes a mounting flange 21 and the second mounting means 20 comprises 2 mounting straps 22*a*, 22*b*. The mounting straps 22*a* and 22*b* are formed integrally with the oil filler pipe 16.

In a preferred embodiment of the invention the multifunction part is made by injection molding by which even relatively complicated components can be formed in a relatively simple way. As material herefor, a heat resistant resin is used.

The oil filler pipe 16 and the oil separator 18 which is arranged at a side 23 of the oil filler pipe 16 adjacent to the air intake module 2 are mounted, by way of the mounting flange 21, to the top side 25 of the cylinder head cover 4 in an area 27 which faces a front side 26 of the cylinder head cover 4 and which is disposed at a distance from the lower end 14*b* of the air intake module 2 by means of bolts 24.

Through the oil filler pipe 16 which is part of the bracing structure 11 oil is filled into the engine for use as lubricant in the engine lubricating system. The oil filler pipe 16 includes at its free end 28*a*, the oil filler neck 17 which can be closed by a cap 29 that projects beyond the top side 30 of the air collector 8. The oil filler pipe 16 includes a kink 31 to provide mounting space for a part of a charge air duct from the air filter to the air compressor of the exhaust gas turbocharger which charge air duct however is not shown in the drawings. The upper end 28*a* of the oil filler pipe 16 is firmly mounted, by way of the two mounting straps 22*a*, 22*b* to the front end 32 of the air intake module 2 to prevent large vibration amplitudes of the air intake module 2.

Within the cylinder head cover 4, there is provided a plenum chamber in the form of a channel which is in communication with the cylinder head 3 by way of an opening. The oil-containing blow-by gases flow from the crankcase by way of a timing chain duct, which is not shown, to the cylinder head 3 and through that opening into the plenum chamber. From the plenum chamber, the blow-by gases flow through a channel 33 to the oil separator 18 wherein the oil entrained in the blow-by gases is separated from the gases. The oil collected in the separator 18 is returned to the oil circulating circuit of the engine by an oil return line 34 which leads from the oil separator 18 to an inlet in the cylinder head cover 4. In this way, the oil separated from the blow-by or crankcase gases is returned from the oil separator to the crankcase of the engine and to the engine lubricating oil circuit.

At its upper end, the oil separator 18 is provided at its discharge side 35 adjacent the oil filler pipe 16 with a connecting stub 36 which is in communication with the air intake module 2 by way of a connecting hose which is not shown in the figure. The blow-by gases are conducted thereby, after removal of the oil droplets therefrom, by way of the connecting hose, to the air intake module 2 and are then returned to the combustion process.

However, the oil separator may be provided as a separate element. Also, the air intake module may comprise two or more parts which are joined together.

What is claimed is:

1. An arrangement for mounting an air intake module on an internal combustion engine including a cylinder head and a cylinder head cover, said air intake module comprising an air collector and air induction pipes mounted on said cylinder head and extending therefrom upwardly to said air collector, said arrangement including an oil filler pipe extending between said air intake module and said cylinder head cover and being mounted thereon at a location spaced from the location where said air induction pipes are mounted to said cylinder head so as to form a bracing structure for said air intake module.

2. An arrangement according to claim 1, wherein said bracing structure is a unitary multi-function component comprising said oil filler pipe with an oil filler neck, at least a first mounting means for mounting said bracing structure to said cylinder head cover and a second mounting means for mounting said bracing structure to said air intake module.

3. An arrangement according to claim 1, wherein said bracing structure includes an oil separator integrally formed therewith.

4. An arrangement according to claim 3, wherein said oil separator includes a discharge side which is in communication with said air intake module by way of a connecting line.

5. An arrangement according to claim 3, wherein said bracing structure including oil separator are formed as an injection molded casting.

* * * * *